US009937375B2

(12) United States Patent
Zhu

(10) Patent No.: US 9,937,375 B2
(45) Date of Patent: Apr. 10, 2018

(54) INDEPENDENT SUSPENSION VIBRATION DAMPING MECHANISM OF RUNNING PLATFORM OF A TREADMILL

(71) Applicant: ZHE JIANG FENG SHANG TECHONOLOGY CO., LTD., Hangzhou (CN)

(72) Inventor: Zhengyuan Zhu, Hangzhou (CN)

(73) Assignee: ZHE JIANG FENG SHANG TECHNOLOGY CO., LTD., Hangzhou (CN)

( * ) Notice: Subject to any disclaimer, the term of this patent is extended or adjusted under 35 U.S.C. 154(b) by 0 days.

(21) Appl. No.: 15/537,766

(22) PCT Filed: Dec. 18, 2015

(86) PCT No.: PCT/CN2015/097968
§ 371 (c)(1),
(2) Date: Jun. 19, 2017

(87) PCT Pub. No.: WO2016/095862
PCT Pub. Date: Jun. 23, 2016

(65) Prior Publication Data

US 2018/0008862 A1 Jan. 11, 2018

(30) Foreign Application Priority Data

Dec. 18, 2014 (CN) ..... 2014 1 0796791

(51) Int. Cl.
*A63B 22/02* (2006.01)
*A63B 71/00* (2006.01)

(52) U.S. Cl.
CPC ..... *A63B 22/0214* (2015.10); *A63B 71/0054* (2013.01)

(58) Field of Classification Search
None
See application file for complete search history.

(56) References Cited

U.S. PATENT DOCUMENTS 5,827,155 A * 10/1998 Jensen ..... A63B 22/02 267/160
6,953,418 B1 * 10/2005 Chen ..... A63B 22/0023 452/54

(Continued)

FOREIGN PATENT DOCUMENTS

CN 2387928 7/2000
CN 2621753 6/2004

(Continued)

OTHER PUBLICATIONS

First Office Action of Chinese application No. CN201410796791.3, with English translation, dated Aug. 23, 201610 pages provided.

(Continued)

*Primary Examiner* — Stephen R Crow
(74) *Attorney, Agent, or Firm* — Hamre, Schumann, Mueller & Larson, P.C.

(57) ABSTRACT

The invention belongs to the technical field of fitness equipment, in particular to the independent suspension vibration damping mechanism of running platform of a treadmill. It solves the problem that the shock effect of the existing treadmill is poor and so on. It includes the chassis and the runway frame. The front end of mentioned runway frame is suspended on the chassis by means of a suspension structure and when the runway frame is subjected to a downward force and forcing the front end of the runway frame to descend, the suspension structure can assist the front end of the runway frame to rise and reset. The independent suspension vibration damping mechanism of running platform of the treadmill has the advantages: simple structure, good stability, good shock absorption effect, providing shock absorption buffer to multiple locations of the treadmill, long span life, and high mechanical strength.

4 Claims, 5 Drawing Sheets

(56) References Cited

U.S. PATENT DOCUMENTS

| | | | | |
|---|---|---|---|---|
| 7,815,550 | B2 * | 10/2010 | Watterson | A63B 22/0221 482/54 |
| 8,435,160 | B1 * | 5/2013 | Clum | A63B 22/02 482/54 |
| 2004/0242378 | A1 * | 12/2004 | Pan | A63B 22/02 482/54 |
| 2007/0225127 | A1 * | 9/2007 | Pan | A63B 22/02 482/54 |
| 2012/0178590 | A1 * | 7/2012 | Lu | A63B 22/0235 482/54 |

FOREIGN PATENT DOCUMENTS

| | | |
|---|---|---|
| CN | 201320367 | 10/2009 |
| CN | 201912700 | 8/2011 |
| CN | 203183576 | 9/2013 |
| CN | 104548485 | 4/2015 |
| CN | 204352455 | 5/2015 |
| WO | 2013134684 | 9/2013 |

OTHER PUBLICATIONS

Second Office Action of Chinese application No. CN201410796791.3, with English translation, dated Dec. 15, 2016, 11 pages provided.

Notification to Grant of Chinese application No. CN201410796791.3, with English translation, dated Apr. 25, 2017, 3 pages provided.

International Search Report issued in the corresponding PCT/CN2015/097968, dated Mar. 24, 2016, 4 pages.

* cited by examiner

INDEPENDENT SUSPENSION VIBRATION DAMPING MECHANISM OF RUNNING PLATFORM OF A TREADMILL

TECHNICAL FIELD

The invention belongs to the technical field of fitness equipment, in particular to the independent suspension vibration damping mechanism of running platform of a treadmill.

BACKGROUND OF THE INVENTION

With the development and progress of society, running fitness has become a new concept of life, but running often needs to be done outdoors, so it's often affected by weather factors, and it is difficult to achieve normalized exercise. Therefore, people began to use the treadmill that can be placed in the room, so as to achieve the purpose of fitness and exercise, the treadmill is not only standing family and gym equipment, but also the most simple modern home fitness equipment, and it is the best choice for family fitness. However, the development of treadmill has come across the problem of poor shock absorber. When the user runs on the treadmill, the treadmill will respond to the trampling force entirely on the human body, causing the great recoil on the user's body parts, especially the ankle, knee and spine, resulting in these parts easily damaged, completely contrary to the purpose of the treadmill as a sports fitness equipment.

In order to solve the problems existing in the existing technology, people have carried on the long-term exploration, and proposed various solutions. For example, the Chinese patent document discloses a damping treadmill [application number: 201320136260.2], which includes pedestals and columns attached together. A framework is arranged above the base. The frame is composed of the first frame and the second frame. One end of the first frame is connected with the column or the base, and the other end is hinged with one end of the second frame through the fixed shaft. A damping device is arranged at the bottom of the frame. The scheme can alleviate the poor damping effect of the existing treadmill to a certain extent, but the scheme uses the spring as the shock absorption, with the spring fatigue, damping effect will be greatly reduced, and the stability is poor, the spring force is small in order to resist deformation, so the shock absorption buffer effect is very limited.

SUMMARY OF THE INVENTION

The invention aims at solving the problem, providing an independent suspension vibration damping mechanism of running platform of a treadmill with simple and reasonable structure, and good stability.

In order to achieve the above purpose, the following technical scheme is adopted: the independent suspension vibration damping mechanism of running platform of a treadmill includes the chassis and the runway frame. It is characterized in that the front end of mentioned runway frame is suspended on the chassis by means of a suspension structure and when the runway frame is subjected to a downward force and forcing the front end of the runway frame to descend, the suspension structure can assist the front end of the runway frame to rise and reset. By adopting the structure, when the treadmill is used, the runway frame is forced downward, and the front end of the runway frame can be automatically reset under the action of the suspension shock proof structure, thereby enhancing the shock absorption effect of the treadmill when used.

In the independent suspension vibration damping mechanism of running platform of a treadmill, the suspension structure comprises at least one cantilever, one end of the cantilever is hinged on the runway frame, the other end is connected with the chassis through an elastic expansion component, and the middle part of the cantilever is hinged on the chassis. Obviously, when the runway frame is loaded downward, the swing of the cantilever is driven, and the cantilever is reset under the action of an elastic component, so that the runway frame automatically rises.

In the independent suspension vibration damping mechanism of running platform of a treadmill, the elastic component comprises a transmission rod; one end of the transmission rod is hinged with the cantilever, the other end passes through the chassis and in the end the elastic blocking body is fixed that can abut on the chassis. That is, the swing of the cantilever makes the conducting rod put on the chassis and moves back and forth, and the elastic barrier can prevent the conduction rod from the chassis.

As another alternative, in the independent suspension vibration damping mechanism of running platform of a treadmill, the elastic component comprises a spring, one end of which is connected to the cantilever and the other end to the chassis. When the cantilever is swung, it is automatically reset under the action of the spring.

In the independent suspension vibration damping mechanism of running platform of a treadmill, the cantilever is L-shaped and the corner of the cantilever is hinged to the chassis, and the length of one end of the cantilever connected to the runway frame is longer than that of one end connected to the elastic component. Obviously, the use of this structure makes the torque of one end of the cantilever connected to the runway frame greater than the other end, easy to force the amplification, which is easier to swing the cantilever.

In the independent suspension vibration damping mechanism of running platform of a treadmill, there are two sets of the suspension structure and symmetrically disposed on both sides of the runway frame. It makes the stability good when the treadmill is used, to ensure the vibration reduction effect of the front end of the running platform.

In the independent suspension vibration damping mechanism of running platform of a treadmill, the runway frame comprises a frame body, and a cantilever frame is fixed at the lower side of the front of the frame body. The cantilever is hinged at the front end of the cantilever frame. A damping cylinder is arranged between the chassis and the middle of the runway frame. One end of the damping cylinder is fixedly connected with the chassis, and the other end is fixedly connected with the runway frame. The damping cylinder here can further improve the cushioning effect.

In the independent suspension vibration damping mechanism of running platform of a treadmill, the frame body is provided with a running plate parallel to the frame body, the running plate is provided with an annular running belt, and an elastic buffer structure is arranged between the running plate and the frame body. Obviously, the elastic cushioning structure here can improve the shock absorption for the rear end of the running platform, so that all the positions of the running platform can be damping.

In the independent suspension vibration damping mechanism of running platform of a treadmill, the elastic buffer structure comprises a plurality of elastic cushioning pieces disposed on both sides of the frame body and located between the frame body and the running plate, and the elastic cushioning pieces are arranged one by one. That is, the elastic cushioning pieces are evenly arranged on both sides of the frame body one by one.

In the independent suspension vibration damping mechanism of running platform of a treadmill, the elastic cushioning pieces comprise the first stripe plate and the second stripe plate arranged correspondingly up and down. The first stripe plate is connected with the side of the running plate. The second stripe plate is fixed on the side of the frame body. Pluralities of buffer springs are arranged between the first strip running plate and the second strip running plate. Obviously, when the running board is down forced, the buffer spring can provide upward reaction force, so as to obtain the effect of cushioning shock absorption.

Compared with the existing technology, the independent suspension vibration damping mechanism of running platform of the treadmill has the advantages: simple structure, good stability, good shock absorption effect, providing shock absorption buffer to multiple locations of the treadmill, long span life, and high mechanical strength.

Figure 1:
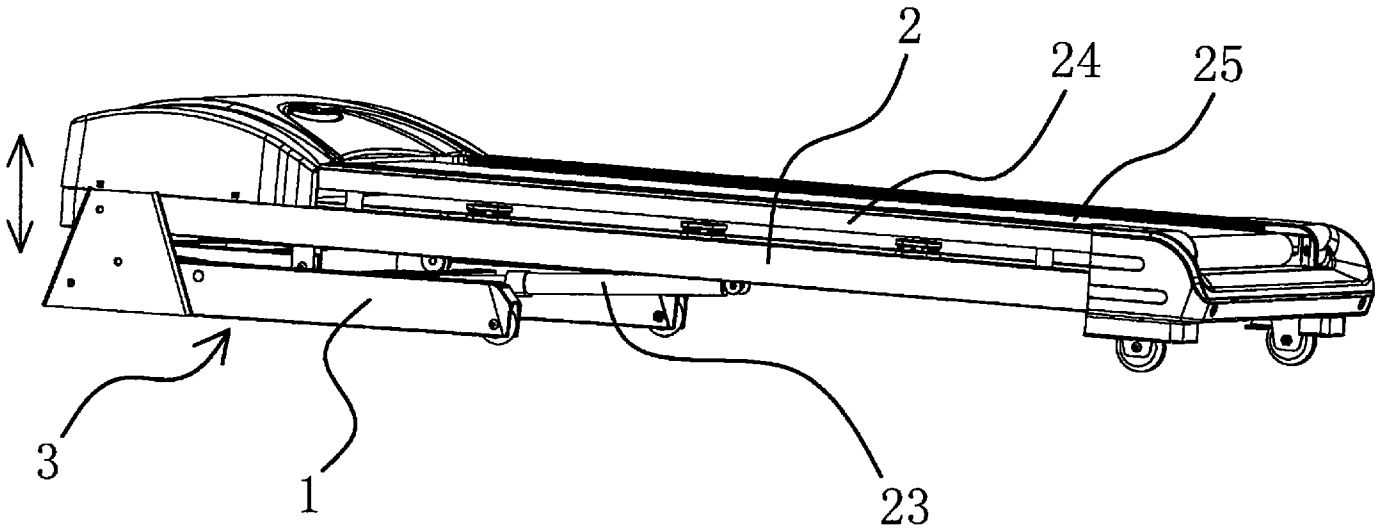
FIG. 1 is a schematic diagram of Embodiment 1 of the present invention.
Figure 2:
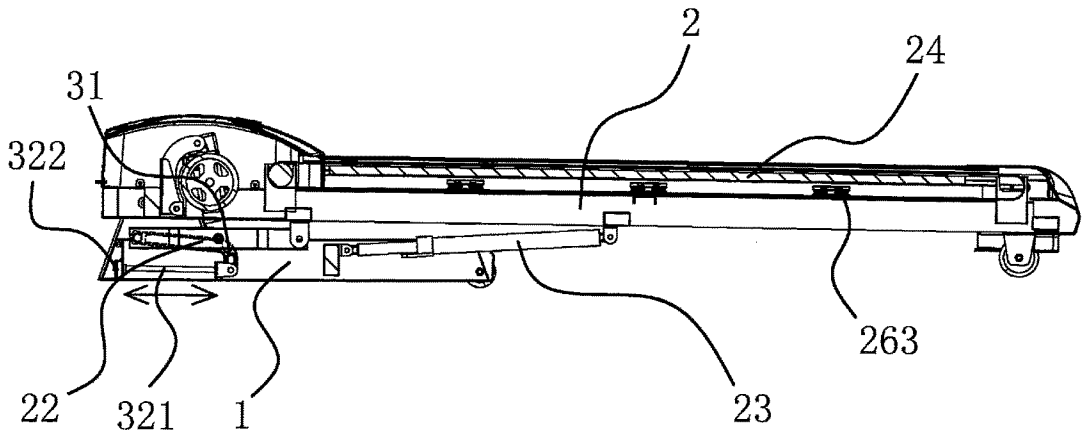
FIG. 2 is a structural cutaway view of Embodiment 1 of the present invention.
Figure 3:
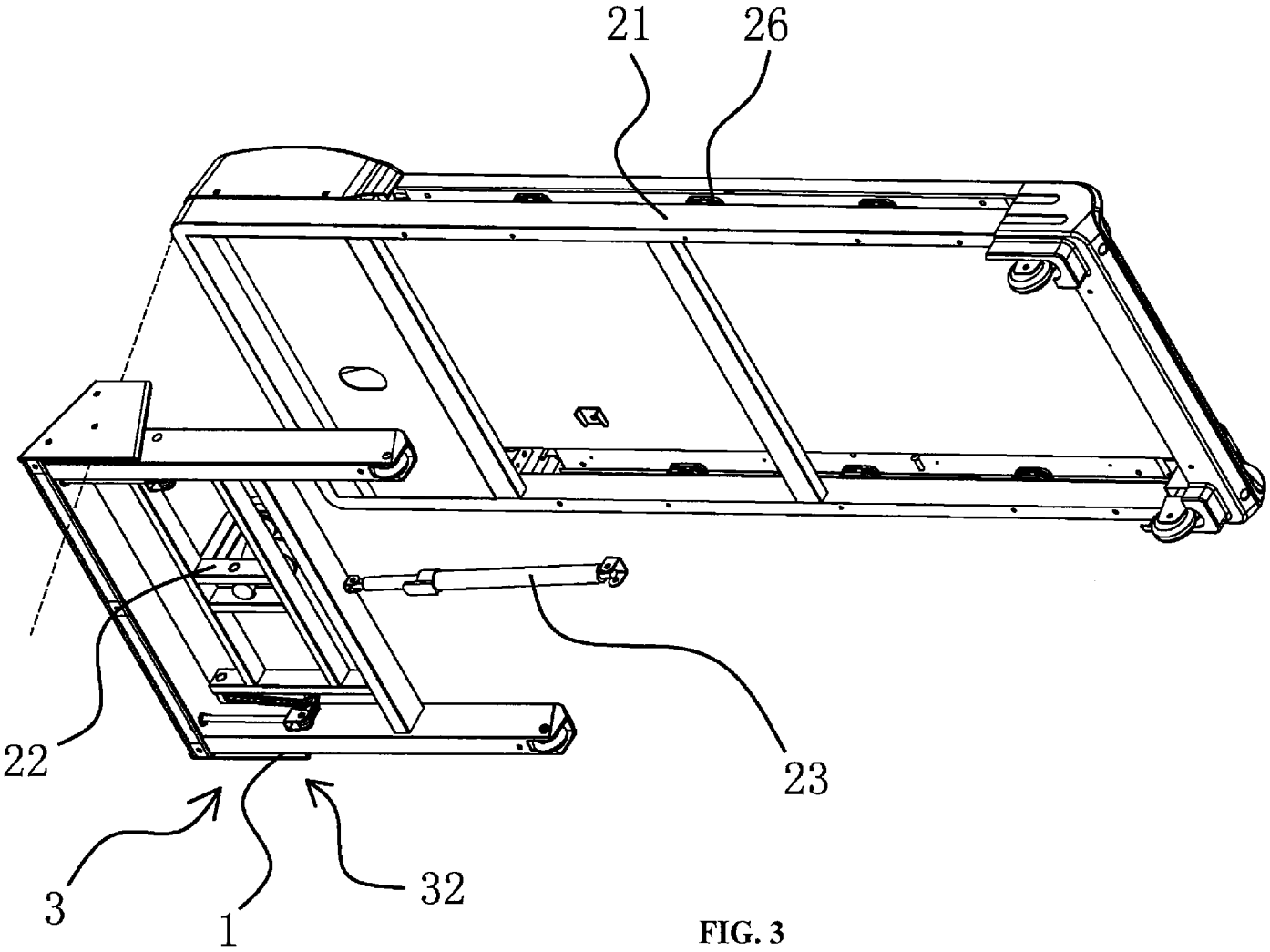
FIG. 3 is an exploded diagram of Embodiment 1 for the present invention.
Figure 4:
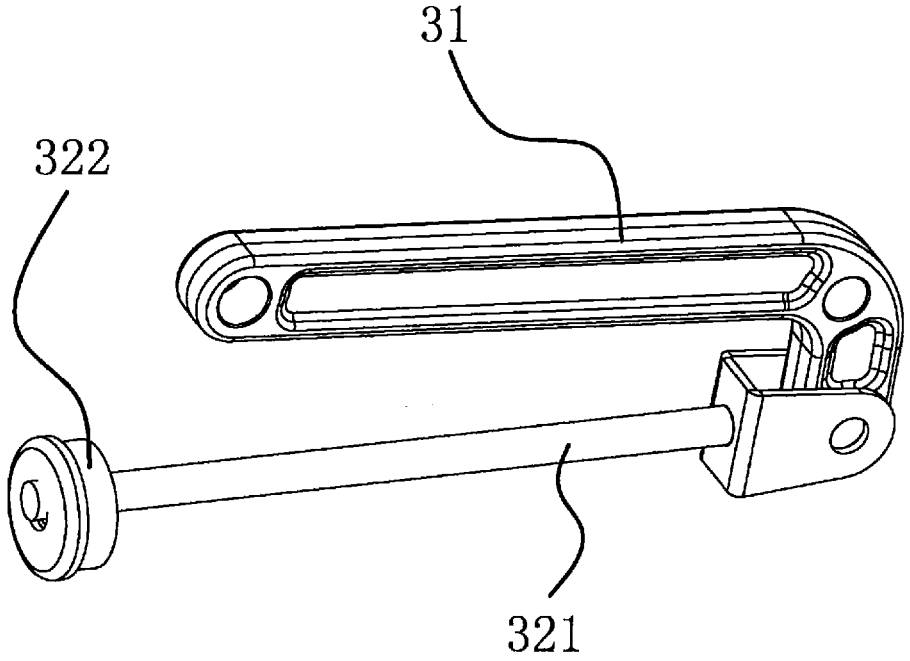
FIG. 4 is a schematic diagram of an elastic component in Embodiment 1 of the present invention.
Figure 5:
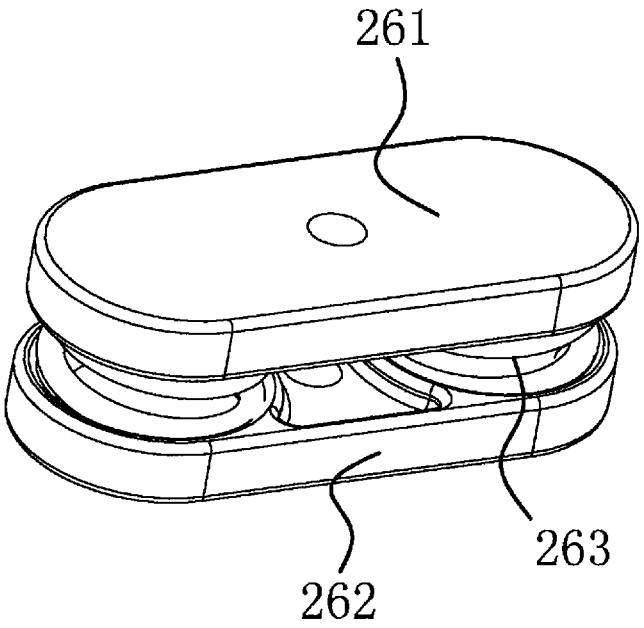
FIG. 5 is a schematic diagram of an elastic buffer in Embodiment 1 of the present invention.

In the figure, chassis 1, runway frame 2, frame body 21, cantilever frame 22, damping cylinder 23, running plate 24, annular running belt 25, elastic buffering piece 26, the first stripe plate 261, the second stripe plate 262, buffer spring 263, suspension structure 3, cantilever 31, elastic component 32, conduction rod 321, elastic blocking body 322, and spring 323.

Specific Implementation Methods

The present invention is further explained in detail with the drawings and the concrete embodiments.

EMBODIMENT 1

As shown in FIG. 1-5, the independent suspension vibration damping mechanism of running platform of the treadmill includes the chassis (1) and the runway frame (2). The front end of runway frame (2) is suspended on the chassis (1) by means of a suspension structure (3) and when the runway frame (2) is subjected to a downward force and forcing the front end of the runway frame (2) to descend, the suspension structure (3) can assist the front end of the runway frame (2) to rise and reset. By adopting the structure, when the treadmill is used, the runway frame is forced downward, and the front end of the runway frame can be automatically reset under the action of the suspension shock proof structure, thereby enhancing the shock absorption effect of the treadmill when used.

Concretely, the suspension structure (3) comprises at least one cantilever (31), one end of the cantilever (31) is hinged on the runway frame (2), the other end is connected with the chassis (1) through an elastic component (32), and the middle part of the cantilever (31) is hinged on the chassis (1). That is, when the runway frame (2) is loaded downward, the swing of the cantilever (31) is driven, and the cantilever (31) is reset under the action of an elastic component (32), so that the runway frame (2) automatically rises. In the present embodiment, the elastic component (32) comprises a transmission rod (321), one end of the transmission rod (321) is hinged with the cantilever (31), and the other end passes through the chassis (1) and in the end the elastic blocking body (322) is fixed that can abut on the chassis (1). That is, the swing of the cantilever (31) makes the conducting rod (321) put on the chassis (1) and moves back and forth, and the elastic blocking body (322) can prevent the conduction rod (321) from the chassis (1).

Further, in the present embodiment, the cantilever (31) is L-shaped and the corner of the cantilever (31) is hinged to the chassis (1), and the length of one end of the cantilever (31) connected to the runway frame (2) is longer than that of one end connected to the elastic component (32). The use of this structure makes the torque of one end of the cantilever (31) connected to the runway frame (2) greater than the other end, easy to force the amplification, which is easier to swing the cantilever (31). There are two sets of the suspension structure (3) and symmetrically disposed on both sides of the runway frame (2). It makes the stability good when the treadmill is used, to ensure the vibration reduction effect of the front end of the running platform.

Further, the runway frame (2) comprises a frame body (21), and a cantilever frame (22) is fixed at the lower side of the front of the frame body (21). The cantilever (31) is hinged at the front end of the cantilever frame (22). A damping cylinder (23) is arranged between the chassis (1) and the middle of the runway frame (2). One end of the damping cylinder (23) is fixedly connected with the chassis (1), and the other end is fixedly connected with the runway frame (2). The damping cylinder (23) here can further improve the cushioning effect. The frame body (21) is provided with a running plate (24) parallel to the frame body (21), the running plate (24) is provided with an annular running belt (25), and an elastic buffer structure is arranged between the running plate (24) and the frame body (21). The elastic cushioning structure here can improve the shock absorption for the rear end of the running platform, so that all the positions of the running platform can be damping.

Specifically, the elastic buffer structure comprises a plurality of elastic cushioning pieces (26) disposed on both sides of the frame body (21) and located between the frame body (21) and the running plate (24), and the elastic cushioning pieces (26) are arranged one by one. That is, the elastic cushioning pieces (26) are evenly arranged on both sides of the frame body (21) one by one. The elastic cushioning pieces (26) comprise the first stripe plate (261) and the second stripe plate (262) arranged correspondingly up and down. The first stripe plate (261) is connected with the side of the running plate (24). The second stripe plate (262) is fixed on the side of the frame body (21). A plurality of buffer springs (263) are arranged between the first strip running plate (24) and the second strip running plate (24). That is, when the running plate (24) is down forced, the buffer spring (263) can provide upward reaction force, so as to obtain the effect of cushioning shock absorption.

EMBODIMENT 2

Figure 6:
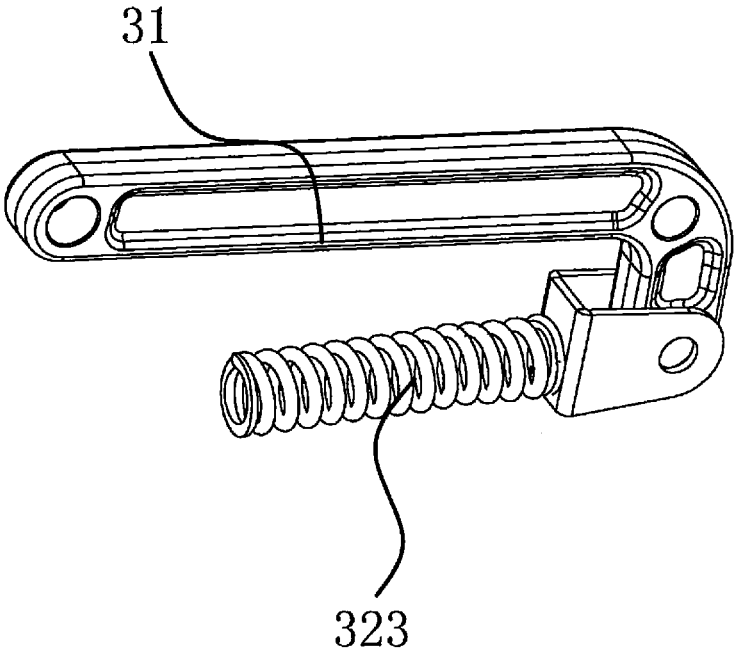
FIG. 6 is a schematic diagram of an elastic component in the Embodiment 2 of the present invention.

As shown in FIG. 6, the structure and the working principle of the present embodiment are basically the same as the embodiment one, and the difference lies in that the elastic component in this embodiment (32) comprises a spring (323), one end of which is connected to the cantilever (31) and the other end to the chassis (1). That is, the cantilever (31) is automatically reset after the action of the spring (323).

The specific embodiments described herein are merely illustrative of the spirit of the invention. It will be understood by those skilled in the technical field to which this invention pertains that various modifications or additions may be made to the described specific embodiments without departing from the scope of the present invention or beyond the spirit of the appended claims defined.

Although in this article there are many terms such as chassis 1, runway frame 2, frame body 21, cantilever frame 22, damping cylinder 23, running plate 24, annular running belt 25, elastic buffering piece 26, the first stripe plate 261, the second stripe plate 262, buffer spring 263, suspension structure 3, cantilever 31, elastic component 32, conduction rod 321, elastic blocking body 322, and spring 323, but it does not preclude the possibility of using other terms. The use of these terms is only for the purpose of more conveniently describing and explaining the nature of the invention; it is contrary to the spirit of the present invention to interpret them as any additional limitation.

The invention claimed is:

1. An independent suspension vibration damping mechanism of running platform of a treadmill comprising:

a chassis; and a runway frame, wherein a front end of the runway frame is suspended on the chassis through a suspension structure and when the runway frame is subjected to a downward force and forcing that forces the front end of the runway frame to descend, the suspension structure assists the front end of the runway frame to rise and reset;

wherein the suspension structure comprises at least one cantilever, a first end of the cantilever is hinged on the runway frame, a second end of the cantilever is connected with the chassis through an elastic component, and a middle part of the cantilever is hinged on the chassis;

wherein the runway frame comprises a frame body, a cantilever frame is fixed at a lower side of a front of the frame body, the cantilever is hinged at a front end of the cantilever frame, a damping cylinder is arranged between the chassis and a middle of the runway frame, a first end of the damping cylinder is fixedly connected with the chassis, and a second end of the damping cylinder is fixedly connected with the runway frame;

wherein two sets of the suspension structure are symmetrically disposed on both sides of the runway frame;

wherein the elastic component comprises a transmission rod, a first end of the transmission rod is hinged with the cantilever, a second end of the transmission rod passes through the chassis, an elastic blocking body is fixed to the second end of the transmission rod, and the elastic blocking body abuts on the chassis; and wherein the cantilever is L-shaped and a corner of the cantilever is hinged to the chassis, and a length of the first end of the cantilever connected to the runway frame is longer than a length of the second end of the cantilever connected to the elastic component.

2. The independent suspension vibration damping mechanism of running platform of a treadmill according to claim 1, wherein the frame body is provided with a running plate parallel to the frame body, the running plate is provided with an annular running belt, and an elastic buffer structure is arranged between the running plate and the frame body.

3. The independent suspension vibration damping mechanism of running platform of a treadmill according to claim 2, wherein the elastic buffer structure comprises a plurality of elastic cushioning pieces disposed on both sides of the frame body and located between the frame body and the running plate, and the elastic cushioning pieces are arranged one by one.

4. The independent suspension vibration damping mechanism of running platform of a treadmill according to claim 3, wherein the elastic cushioning pieces comprise a first stripe plate and a second stripe plate arranged correspondingly up and down, the first stripe plate is connected with a side of the running plate, the second stripe plate is fixed on a side of the frame body, a plurality of buffer springs is arranged between the first strip running plate and the second strip running plate.

* * * * *